US005125242A

United States Patent [19]

von Blanquet

[11] Patent Number: 5,125,242

[45] Date of Patent: Jun. 30, 1992

[54] ICE DISPENSING AND CRUSHING APPARATUS

[75] Inventor: Georg von Blanquet, Baden-Baden, Fed. Rep. of Germany

[73] Assignee: Gaggenau-Werke Haus- und Lufttechnik GmbH, Gaggenau, Fed. Rep. of Germany

[21] Appl. No.: 692,258

[22] Filed: Apr. 26, 1991

[30] Foreign Application Priority Data

Apr. 30, 1990 [DE] Fed. Rep. of Germany ..... 4013825

[51] Int. Cl.[5] ..... F25C 5/02

[52] U.S. Cl. ..... 62/320; 62/344; 198/453; 198/671; 222/146.6; 222/405; 222/564

[58] Field of Search ..... 62/344, 320; 198/396, 198/453, 671; 222/146.6, 405, 564

[56] References Cited

U.S. PATENT DOCUMENTS

| | | | |
|---|---|---|---|
| 2,336,606 | 12/1943 | Everett | 198/453 X |
| 2,719,624 | 10/1955 | Fox et al. | 198/396 |
| 3,341,065 | 9/1967 | Schuldt et al. | 222/1 |
| 3,902,331 | 9/1975 | True, Jr. et al. | 62/137 |
| 3,918,266 | 11/1975 | Gindy et al. | 62/137 |
| 4,176,527 | 12/1979 | Linstromberg et al. | 62/320 |
| 4,850,515 | 7/1989 | Cleland | 198/671 X |

FOREIGN PATENT DOCUMENTS

| | | |
|---|---|---|
| 1944142 | 3/1970 | Fed. Rep. of Germany . |
| 2108031 | 9/1971 | Fed. Rep. of Germany . |
| 2424252 | 11/1974 | Fed. Rep. of Germany . |
| 1337647 | 11/1973 | United Kingdom . |

*Primary Examiner*—William E. Tapolcai
*Attorney, Agent, or Firm*—Wenderoth, Lind & Ponack

[57] ABSTRACT

An ice dispensing and crushing apparatus is disclosed for dispensing and selectively crushing pieces of ice. The apparatus includes a supply bin for containing and supplying pieces of ice, a conveying trough formed at least partially within a lower portion of the supply bin and extending in an inclined manner toward a dispensing housing through which ice pieces can be dispensed. A helical conveyor is mounted for rotation in the conveying trough and is operable to convey individual pieces of ice one-by-one toward a dispensing opening formed in a lateral side of the dispensing housing. An ejection device, such as an ejection bar, is mounted adjacent the helical conveyor and acts to eject extra pieces of ice so as to assure the individual successive conveyance of the ice pieces. A crushing device is disposed at the dispensing end of the helical conveyor and includes rotatable arms which rotate with the helical conveyor, and pivotably mounted anvil members which are movable between operative and inoperative position. The anvil members can be selectively moved from their inoperative positions into their operative positions wherein they partially extend through the dispensing opening of the dispensing housing, by a selectively actuable magnetic solenoid. Undesirable crushing of ice pieces is thus avoided because the anvil members are retracted from the dispensing housing when no crushing is desired. A water-return duct is formed at a bottom portion of the dispensing housing so as to return melted ice to the supply bin.

25 Claims, 3 Drawing Sheets

ICE DISPENSING AND CRUSHING APPARATUS

BACKGROUND OF THE INVENTION

1. Field of the Invention

The present invention is directed to an apparatus for dispensing and crushing ice, and more particularly to an ice dispensing and crushing apparatus which utilizes a helical conveyor.

2. Description of the Prior Art

An ice dispensing apparatus for use with a household refrigerator is disclosed in U.S. Pat. No. 3,902,331. This device utilizes an open-turn type of helical conveyor for transporting small pieces of ice toward an ice dispensing opening. Although the patent does not disclose the inclusion of any particular type of ice crusher, it does disclose that an ice crusher can be disposed in an ice discharge housing.

A combination ice cube and crushed ice dispenser is disclosed in British patent specification 1,337,647. The dispensing portion of this device includes a helical conveyor which is connected with the ice crushing portion of the device. The ice crushing portion includes a plurality of motor driven rotatable ice crushing arms which are adapted to carry and crush ice against a stationary ice crushing arm. A selectively movable member is provided which, when in an operative position, intercepts pieces of ice as they are fed by the helical conveyor through an opening into the crushing portion of the device so that the ice pieces can be engaged by the rotatable arms and carried thereby to be crushed against the stationary ice crushing arm. When the ice intercepting member is in a non-operative position, the ice is ideally conveyed by the helical conveyor through the opening and into the crushing portion but, rather than being engaged by the rotatable arms, is dispensed directly through the discharge opening. However, even with the intercepting member in its non-operative position, since the stationary arm remains in position, the rotatable arms are likely to engage a certain portion of the ice and carry it to be crushed against the stationary arm, thereby resulting in a certain amount of crushed ice being dispensed along with the uncrushed ice.

In addition, various open and closed type helical conveyors for transporting small pieces of ice from an ice supply bin are described in German Publication DE-OS 24 24 252, and U.S. Pat. Nos. 3,341,065 and 3,918,266.

SUMMARY OF THE INVENTION

An object of the present invention is to provide an ice dispensing and crushing device which successively and selectively dispenses individual pieces of ice.

A further object of the invention is to provide an ice dispensing and crushing device wherein the ice is crushed only when the crushing portion of the device is switched on.

A still further object of the invention is to provide an ice dispensing and crushing device wherein jamming of the device by pieces of ice lodged in the dispensing opening is prevented, and wherein dripping of water from the dispenser opening caused by the melting of ice lodged therein is prevented.

These objects are attained, according to the prevent invention, by providing an ice dispensing and crushing apparatus which can be used either as an independent assembly or can be integrated into a refrigerator device. The apparatus according to the invention includes an ice supply bin mounted beneath an ice making device, an ice dispensing housing mounted relative to the supply bin and having an ice dispensing opening, a conveying trough extending between the supply bin and the dispensing housing such that it slopes upwardly toward the ice dispensing housing, a conveying means for conveying pieces of ice along the conveying trough from the supply bin to the dispensing housing, and an ejection means for ejecting an extra piece of ice from being conveyed to the dispensing opening. The conveying means comprises a helical conveyor mounted in the trough to extend therealong and having a predetermined pitch adapted to correspond to a predetermined size of the pieces of ice. The term "extra" piece of ice is intended to mean any pieces of ice over and above a single piece of ice which are disposed between a respectively adjacent pair of helical turns of the helical conveyor.

The helical conveyor comprises an open-type helical conveyor, and, in one preferred embodiment of the invention, the ejection means comprises an ejection bar mounted in the trough adjacent the helical conveyor. The ejection bar is formed with a ramp portion along one longitudinally elongated face thereof which faces the helical conveyor such that, when an extra piece of ice is fed through the helical conveyor from one lateral side of the trough to the other, the extra piece of ice is forced to ride up and over the ramp portion of the ejection bar such that it will then slide downwardly along the trough and back into the supply bin.

The apparatus is also provided with an ice crushing means comprising rotatable arms rotatable about a first axis and having free ends which move along a circular path when the rotatable arm are rotated, and anvil members, each of which is pivotable about a second axis between an operative position in which a portion thereof extends inwardly through the dispensing opening and across the circular path such that an ice piece carried by the rotatable arm can be crushed against the anvil member, and an inoperative position in which the anvil member is retracted away from the circular path and substantially outwardly from the dispensing opening. The ice crushing means also includes a moving means for selectively moving the anvil members between their operative and inoperative positions.

The moving means preferably comprises at least one rod member mounted to at least one of the anvil members at a location offset from the second axis, and at least one solenoid operatively connected to the at least one rod member. A biasing means is provided for biasing the anvil members toward their inoperative positions, and a stop means is provided to stop the anvil members from pivoting beyond a predetermined position which defines the operative positions of the anvil members. The rotatable arms are preferably provided with teeth for aiding in the engagement of ice pieces, and the anvil members are shaped as circle segments and have free ends which comprise smooth curved surfaces extending along a circular arc with a central axis coincident with the second axis.

Because of the inclined orientation of the helical conveyor, and because of the fact that the conveyor has a constant pitch which corresponds to a predetermine size of the pieces of ice to be conveyed, as the pieces of ice are conveyed upwardly along the trough, they are forced to one side of the helical conveyor. However, if an extra piece of ice, i.e. a second piece of ice disposed between a respectively adjacent pair of the helical turns of the conveyor, is present, such extra piece of ice is caused to migrate through the open-type helical conveyor from one lateral side of the trough to the other, and then encounters the ejection bar. The ejection bar acts to deflect the extra piece of ice upwardly and over the top of the ejection bar, such that it drops back into the supply bin. In order to have the ejection means properly eject extra pieces of ice, it is necessary that the ejecting means be mounted above the level to which the supply bin is to be filled with ice. Also, so that the extra pieces of ice can be properly ejected, it is best that the ejecting means be mounted laterally of the helical conveyor and along a junction between the trough and an inner sidewall surface of the supply bin above the aforementioned level to which ice is to be filled into the supply bin. The surface of the ejection bar is preferably rounded off, so that pieces of ice can slide along or across the surface.

As an alternative to an ejection bar, the ejection means can comprise an ejection recess, e.g. such as an ejection channel, to direct extra pieces of ice back to the supply bin.

In order to avoid the problem of having melting or melted ice drip from the dispensing opening of the dispensing apparatus, a dispensing socket or housing can be provided at the dispensing end of the helical conveyor, such socket having a laterally disposed dispensing opening and a gutter-like lower portion which allows the melted or melting ice to be returned to the supply bin and, in turn to a water drain provided therein.

Accordingly, the present invention provides a combined ice dispensing and crushing apparatus by which individual pieces of ice can be successively conveyed to a dispensing opening, and whereby the ice pieces can be selectively crushed by having rotatable arms which can selectively either carry the ice pieces toward the dispensing opening or to be crushed against the anvil members. Any dripping of water by the pieces of ice which may remain in the dispensing socket or housing when the helical conveyor is inoperative would merely result in a return flow of water into the supply bin, such that dripping of ice water out of the dispensing opening is prevented.

BRIEF DESCRIPTION OF THE DRAWINGS

The present invention will now be more fully described in connection with the drawing figures, in which.

DETAILED DESCRIPTION OF THE INVENTION

Figure 1:
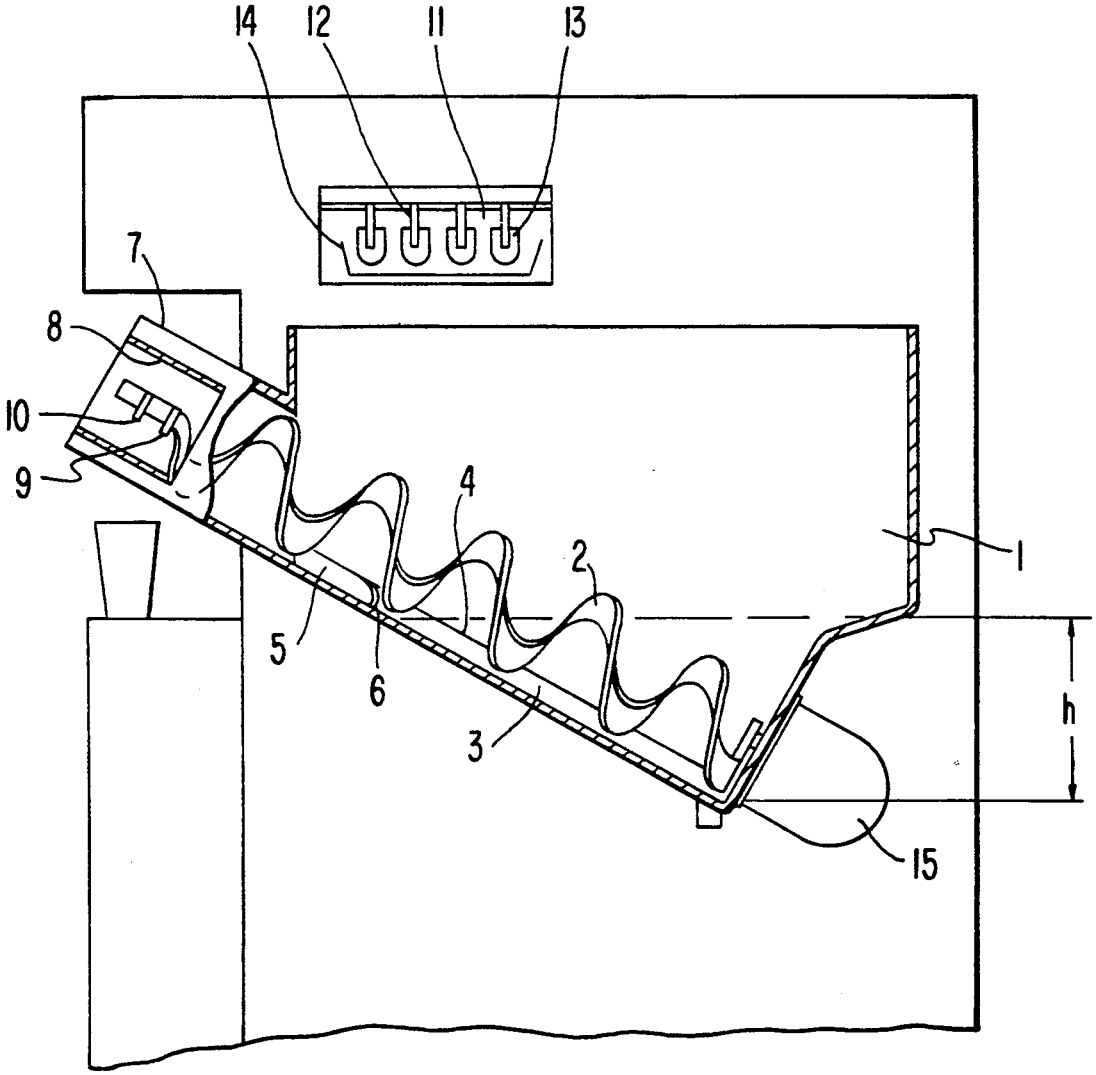
FIG. 1 is a partially sectional view of the ice dispensing and crushing apparatus of the invention installed in a household refrigerator.

FIG. 1 shows a household refrigerator having an ice making device 11 mounted therein. Below the ice making device 11, an ice supply bin 1 is mounted and is adapted to contain pieces of ice, and in particular is adapted to contain pieces of ice up to a height h. Means for assuring that the pieces of ice are filled into the supply bin 1 up to only a height h are well known. Any suitable known means can be utilized for this purpose in the present invention. Such a known means is, for example, described in German publication 17 76 189.

An inclined bottom surface 6 of the supply bin 1 is formed with a conveying trough 3. An open-type helical conveyor 2 is rotatably mounted partially in the conveying trough 3 for rotation about an axis A. As shown in FIG. 1, what is meant by an open-type helical conveyor is that the helical turns of the helical conveyor are not fixed about a central core. The conveying trough 3 is at least partially defined by a junction 4 between a flat inner surface of the supply bin 1 and a curved surface of the conveying trough 3 (see FIG. 3). Although any suitable drive means can be employed for rotating the helical conveyor 2, in the preferred embodiment of the invention, the helical conveyor 2 is rotatably driven by an electric rotary motor 15. In the particular embodiment shown in the drawing figures, the helical conveyor 2 is to be rotated in the counterclockwise direction as viewed from the position of the electric rotary motor 15.

Near the upper end of the conveying trough 3, an ejection bar 5 is mounted on the side of the helical conveyor 2 opposite the junction 4. The ejection bar 5 preferably includes a ramp portion 5' which has a rounded shape, and is preferably also wedge-shaped as viewed from the side thereof so as to provide a run-up surface 6, which is also preferably rounded off, for the pieces of ice.

A dispensing socket or housing 7 is mounted at the dispensing end of the supply bin 1 and has disposed therein the upper portion of the helical conveyor 2. The dispensing housing 7 has a laterally opening dispensing opening 8 for dispensing of the pieces of ice or crushed ice. Also disposed in the dispensing housing 7 is an ice crushing device which will be described later. The ice making device 11 referred to previously is adapted to freeze small hollow pieces of ice 13. Such ice pieces 13 are frozen on a plurality of cooling fingers 12, as schematically shown in FIG. 1, which are shown disposed above the supply bin 1. After the pieces of ice 13 have reached a predetermined thickness, they are caused to drop into the supply bin 1 due to heating of the cooling fingers 12 as a trough 14 is moved away.

Figure 2:
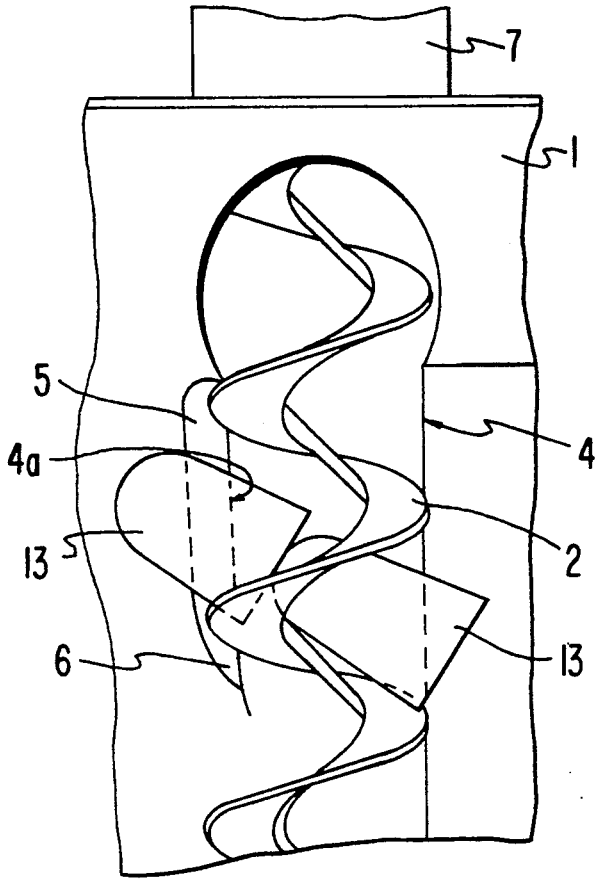
FIG. 2 is a partially cut away top view of a helical conveyor disposed within a supply bin, according to the present invention.
Figure 3:
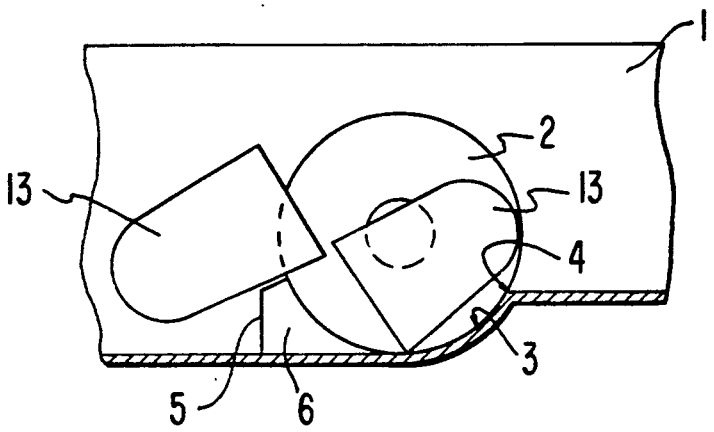
FIG. 3 illustrates the ejection of an extra piece of ice from the helical turns of the helical conveyor.

In operation, the helical conveyor 2 is rotatably driven so as to transport ice pieces 13 upwardly along the right side thereof, as seen FIGS. 2 and 3. The pitch of the helical conveyor 2 is preferably a constant pitch which corresponds to a predetermined size of the ice pieces 13. Due to this constant pitch of the helical conveyor and to the open condition of the central portion of the helical conveyor 2, as the ice pieces 13 are conveyed upwardly along the right side of the trough 3, if an extra ice piece (i.e. a second ice piece disposed between a respectively adjacent pair of the helical turns of the helical conveyor 2) is present, it will be forced through the helical conveyor 2 from one lateral side of the trough 3 to the other, such that the extra ice piece 13 will be forced to ride up and over the ramp portion 5' of the ejection bar whereby it will fall back into the supply bin 1 (see FIGS. 2 and 3). Accordingly, it is assured that the helical conveyor 2 will convey ice pieces 13 upwardly toward the dispensing opening 8 such that only one ice piece 13 at a time will be dispensed. This feature is convenient for the user and also prevents jamming of the apparatus.

As discussed previously, the invention also contemplates providing a means for crushing the ice pieces conveyed upwardly by the helical conveyor 2 toward the dispensing opening 8. Accordingly, the ice crushing device of the invention comprises at least one, and preferably two or more, rotatable arms 9, 10 mounted to and fixed for rotation with the helical conveyor 2 about the axis of rotation A. As shown best in FIGS. 4 and 5, each of these rotatable arms 9, 10 is provided with ice-engaging teeth along the leading edges thereof in the direction of rotation of the rotatable arms 9, 10 and the helical conveyor 2 (as shown by the arrow in FIG. 4). The ice crushing device further includes at least one and preferably three anvil members 17 mounted for pivotable movement about a second axis 16 defined by a pivot pin or the like. Each of the anvil members 17 is shaped as a segment of a circle and has a free end which comprises a smooth curved surface extending along a circular arc. This circular arc coincides with the arc traced by the free end of each of the anvil members 17 as they are pivoted about their pivot axis 16, wherein the radius of curvature of the free ends of the anvil members 17 is shown in FIG. 5 as r. These anvil members are to be interleaved with the rotatable arms 9, 10 such that, when the rotatable arms 9, 10 carry pieces of ice 13 toward the anvil members, the pieces of ice will be crushed thereagainst.

Figure 4:
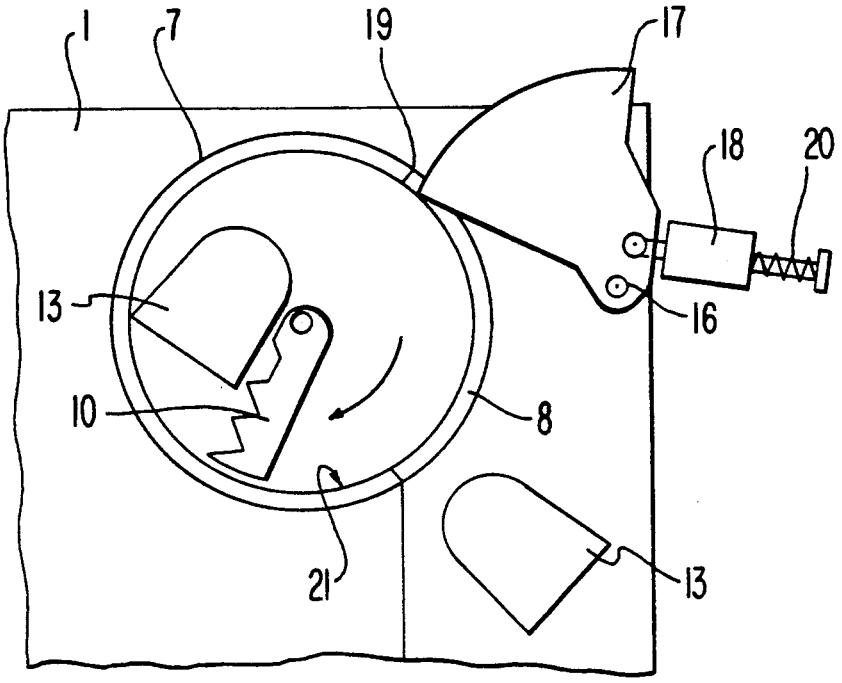
FIG. 4 is a partially cut away front view of a crushing device in its inoperative position.
Figure 5:
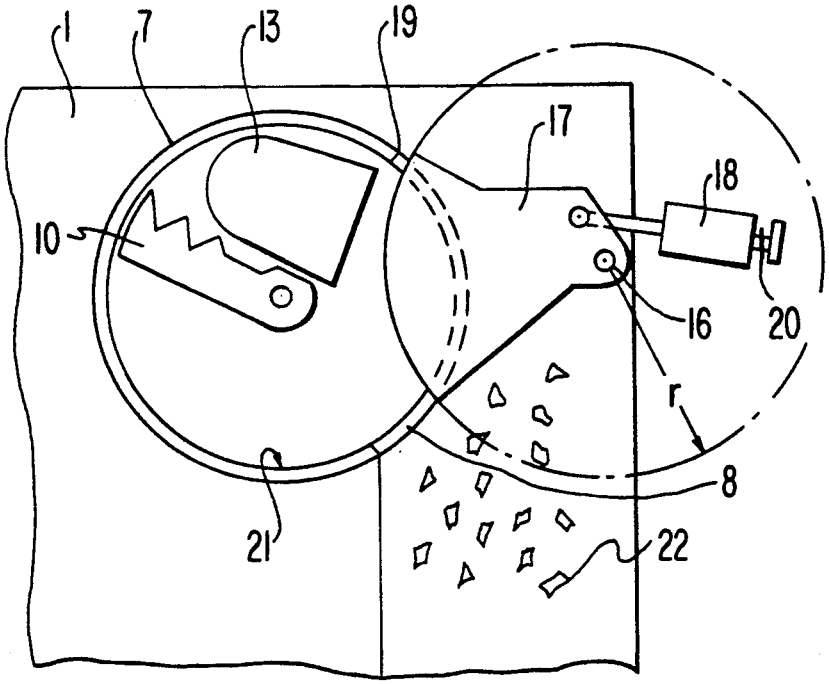
FIG. 5 is a partially cut away front view similar to FIG. 4, except that the crushing device is in its operative position for crushing the pieces of ice.

The anvil members 17 are mounted for pivotable movement about their common pivot axis 16 between inoperative retracted positions as shown in FIG 4, and operative positions wherein the anvil members extend partially into the dispensing housing 7 through the dispensing opening 8. In order to selectively move the anvil members 17 between their operative and inoperative positions, at least one magnetic solenoid 18 is rigidly mounted relative to the dispensing housing 7 and is operatively connected to the anvil members 17 by way of at least one rod member 17*a* pivotally connected to the anvil members 17 at a pivot point 17*b* which is offset from the axis 16. So as to normally maintain the anvil members 17 in their inoperative positions, a compression spring 20 is mounted about the rod member 17*a* to urge the rod member 17*a*, and thus the anvil members 17, towar retracting positions as shown in FIG 4. In addition, a stop means 19 is provided in order to limit the extent of the pivotal motion of the anvil members 17 toward their operative positions, and thus defining the operative positions of the anvil members 17. The stop means are preferably fixed to the dispenser housing 7 at an upper edge of the dispensing opening 8 as shown in FIGS. 4 and 5, and can be formed of any suitable material.

In operation, when the anvil members 17 are in inoperative positions (as shown in FIG. 4) and ice pieces 13 are conveyed upwardly by the helical conveyor 2 into the dispenser housing 7, the rotatable arms 9, 10 rotating in the direction shown by the arrow in FIG. 4 carry the ice pieces 13 toward the dispensing opening 8 formed laterally in the dispensing housing 7. However, when the anvil members 17 are in their operative positions as shown in FIG. 5, as the rotatable arms 9, 10 carry the ice pieces 13 toward the dispensing opening 8, the ice pieces 13 are forced against the smooth surfaces at the free ends of the anvil members 17, thereby crushing the ice pieces and then forcing the crushed ice out through the dispensing opening 8 (as shown in FIG. 5). Accordingly, since the anvil members 17 are only moved into their operative positions when it is desired to obtain crushed ice, but are otherwise maintained in their inoperative positions, the ice pieces 13 can be properly dispensed from the laterally disposed dispensing opening 8 without the possibility of some of the ice pieces being crushed either partially or fully.

Because the dispensing opening 8 is formed on a lateral side of the dispensing housing 7, the bottom portion of the dispensing housing 7, along with the bottom portion of the trough 3, acts as a water-return duct 21 for returning any fully or partially melted ice to the supply bin, where it can be dispensed through a suitable drain. With this arrangement, the ice dispensing and crushing apparatus of the present invention avoids the problem of having water and ice drip from the dispensing opening of the apparatus.

The provision of the ejection means, such as the ejection bar 5, assures that the ice will be properly transported to the dispenser housing 7, and thus through the dispensing opening 8 in a controlled succession in which ice pieces 13 are dispensed one at a time.

The ice dispensing and crushing apparatus of the present invention can be utilized as either an independent assembly or as a component of a refrigerator or ice box. Accordingly, the refrigerator has not been described in further detail as it does not form an integral part of the of the invention, and can be constructed in any suitable manner.

Although the invention has been fully described above in connection with a specific contemplated embodiment, various modifications will be apparent to those of ordinary skill in the art. Accordingly, the scope of the present invention is to be limited only in accordance with the appended claims.

What is claimed:

1. An apparatus for use with an ice supply bin, and a trough extending between the supply bin and an ice dispensing opening, said apparatus comprising:

conveying means for conveying pieces of ice along the trough from the supply bin to the ice dispensing opening, said conveying means comprising a helical conveyor adapted to be mounted to extend along the trough and having a predetermined pitch adapted to correspond to a predetermined size of the pieces of ice; and ejecting means for ejecting a piece of ice and preventing it from being conveyed to said dispensing opening when more than one piece of ice is disposed between a respectively adjacent pair of helical turns of said helical conveyor.

2. An apparatus as recited in claim 1, wherein said helical conveyor comprises an open-type helical conveyor; and said ejecting means comprises an ejection bar adapted adjacent said helical conveyor.

3. An apparatus as recited in claim 2, wherein said ejection bar has a ramp portion along one longitudinally elongated face thereof, said ramp portion being adapted to face said helical conveyor such that, when an extra piece of ice is disposed between a respectively adjacent pair of said helical turns, the extra piece of ice is fed through the helical conveyor from one lateral side of the trough to the other and is forced to ride up and over said ramp portion of said ejection bar.

4. An apparatus as recited in claim 1, wherein said predetermined pitch of said helical conveyor is constant.

5. An apparatus as recited in claim 1, further comprising ice crushing means, operatively coupled with said conveying means, for selectively crushing ice pieces conveyed by said conveying means.

6. An apparatus as recited in claim 5, wherein said ice crushing means comprises:

at least one rotatable arm, rotatable about a first axis, having a free end which moves along a circular path when said rotatable arm is rotated;

at least one anvil member pivotable about a second axis between an operative position in which a portion thereof extends across said circular path such that an ice piece carried by said rotatable arm can be crushed against said anvil member, and an inoperative position in which said anvil member is retracted away from said circular path; and moving means for selectively moving said anvil member between said operative and inoperative positions.

7. An apparatus as recited in claim 6, wherein said moving means comprises a solenoid operatively connected to said anvil member at a location offset from said second axis.

8. An apparatus as recited in claim 7, wherein said ice crushing means further comprises biasing means for biasing said anvil member toward said inoperative position.

9. An apparatus as recited in claim 6, wherein said first axis extends longitudinally and centrally through said helical conveyor; and said at least one rotatable arm is fixed for rotation with said helical conveyor about said first axis.

10. An apparatus as recited in claim 6, wherein said at least one rotatable arm has teeth formed along a leading edge thereof for engaging ice pieces.

11. An apparatus as recited in claim 6, wherein said at least one anvil member is shaped as a segment of a circle and has a free end which comprises a smooth curved surface extending along a circular arc having a center of curvature coincident with said second axis.

12. An apparatus as recited in claim 6, wherein said crushing means further comprises stop means for stopping said anvil member from pivoting beyond a predetermined position, said predetermined position defining said operative position of said anvil member.

13. An apparatus comprising:

an ice supply bin;

an ice dispensing housing mounted relative to said supply bin and having an ice dispensing opening;

a trough extending between said supply bin and said dispensing housing;

conveying means for conveying pieces of ice along said trough from said supply bin to said dispensing housing, said conveying means comprising a helical conveyer mounted in said trough to extend therealong and having a predetermined pitch adapted to correspond to a predetermined size of the pieces of ice; and ejecting means for ejecting a piece of ice and preventing it from being conveyed to said dispensing opening when more than one piece of ice is disposed between a respectively adjacent pair of helical turns of said helical conveyor.

14. An apparatus as recited in claim 13, wherein said helical conveyor comprises an open-type helical conveyer; and said ejecting means comprises an ejection bar mounted adjacent said helical conveyor.

15. An apparatus as recited in claim 14, wherein said ejection bar has a ramp portion along one longitudinally elongated face thereof, said ramp portion facing said helical conveyor such that, when an extra piece of ice is disposed between a respectively adjacent pair of said helical turns, the extra piece of ice is fed through said helical conveyor from one lateral side of said trough to the other and is forced to ride up and over said ramp portion of said ejection bar.

16. An apparatus as recited in claim 13, wherein said predetermined pitch of said helical conveyor is constant.

17. An apparatus as recited in claim 13, wherein said trough is sloped upwardly from said supply bin to said dispenser housing.

18. An apparatus as recited in claim 13, further comprising ice crushing means, operatively coupled with said conveying means, for selectively crushing ice pieces conveyed by said conveying means.

19. An apparatus as recited in claim 18, further comprising said ice crushing means comprises:

at least one rotatable arm rotatable about a first axis and having a free end which moves along a circular path when said rotatable arm is rotated;

at least one anvil member pivotable about a second axis between an operative position in which a portion thereof extends inwardly through said dispensing opening and across said circular path such that an ice piece carried by said rotatable arm can be crushed against said anvil member, and an inoperative position in which said anvil member is retracted away from said circular path and substantially outwardly from said dispensing opening; and moving means for selectively moving said anvil member between said operative and inoperative positions.

20. An apparatus as recited in claim 19, wherein said moving means comprises a solenoid operatively connected to said anvil member at a location offset from said second axis.

21. An apparatus as recited in claim 20, wherein said ice crushing means further comprises biasing means for biasing said anvil member toward said inoperative position.

22. An apparatus as recited in claim 19, wherein said first axis extends longitudinally and centrally through said helical conveyor; and said at least one rotatable arm is fixed for rotation with said helical conveyor about said first axis.

23. An apparatus as recited in claim 19, wherein said at least one rotatable arm has teeth formed along a leading edge thereof for engaging ice pieces.

24. An apparatus as recited in claim 19, wherein said at least one anvil member is shaped as a segment of a circle and has a free end which comprises a smooth curved surface extending along a circular arc having a center of curvature coincident with said second axis.

25. An apparatus as recited in claim 19, wherein said crushing means further comprises stop means for stopping said anvil member from pivoting beyond a predetermined position, said predetermined position defining said operative position of said anvil member.

* * * * *